US011705087B2

(12) United States Patent
Gao

(10) Patent No.: US 11,705,087 B2
(45) Date of Patent: Jul. 18, 2023

(54) DISPLAY DEVICE AND CHARGING CONTROL METHOD APPLIED IN DISPLAY DEVICE

(71) Applicant: TCL CHINA STAR OPTOELECTRONICS TECHNOLOGY CO., LTD., Guangdong (CN)

(72) Inventor: Xiang Gao, Shenzhen (CN)

(73) Assignee: TCL CHINA STAR OPTOELECTRONICS TECHNOLOGY CO., LTD., Guangdong (CN)

( * ) Notice: Subject to any disclaimer, the term of this patent is extended or adjusted under 35 U.S.C. 154(b) by 534 days.

(21) Appl. No.: 16/963,650

(22) PCT Filed: May 20, 2020

(86) PCT No.: PCT/CN2020/091340
§ 371 (c)(1),
(2) Date: Jul. 21, 2020

(87) PCT Pub. No.: WO2021/223270
PCT Pub. Date: Nov. 11, 2021

(65) Prior Publication Data

US 2023/0119528 A1 Apr. 20, 2023

(30) Foreign Application Priority Data

May 6, 2020 (CN) ..... 202010373455.3

(51) Int. Cl.
*G09G 5/00* (2006.01)

(52) U.S. Cl.
CPC ..... *G09G 5/006* (2013.01); *G09G 2310/0251* (2013.01); *G09G 2310/08* (2013.01); *G09G 2320/0223* (2013.01); *G09G 2370/08* (2013.01)

(58) Field of Classification Search
CPC ..... G09G 5/006; G09G 2310/0251; G09G 2310/08; G09G 2310/00; G09G 2320/00;
(Continued)

(56) References Cited

U.S. PATENT DOCUMENTS

2005/0190127 A1* 9/2005 Tomohara ..... G09G 3/3216 345/76
2007/0279407 A1* 12/2007 Vasquez ..... G09G 5/006 345/213

(Continued)

FOREIGN PATENT DOCUMENTS

CN 101071545 A 11/2007
CN 103151005 A * 6/2013

(Continued)

OTHER PUBLICATIONS

English Translation of CN 103151005 A.*

*Primary Examiner* — Pegeman Karimi
(74) *Attorney, Agent, or Firm* — PV IP PC; Wei Te Chung; Zhigang Ma

(57) ABSTRACT

The present invention provides a display device. The display device includes a timing controller, a data register, a source driver, and a display panel. A portion of a vertical effective display column data in a vertical idle period is output through the data register, which can increase a sum of charging time of a pixel column of an entire frame of images. Moreover, an N/2th horizontal idle period to the Nth horizontal idle period are adjusted to improve display uniformity of an upper half screen and a lower half screen.

17 Claims, 1 Drawing Sheet

(58) Field of Classification Search
CPC ..... G09G 5/003; G09G 5/00; G09G 2370/00; G09G 2320/0223; G09G 2370/08; G06T 1/00
See application file for complete search history.

(56) References Cited

U.S. PATENT DOCUMENTS

| | | | | |
|---|---|---|---|---|
| 2014/0085275 | A1* | 3/2014 | Tripathi | G09G 5/005 345/204 |
| 2018/0174551 | A1* | 6/2018 | Ansari | G09G 5/12 |

FOREIGN PATENT DOCUMENTS

| | | | |
|---|---|---|---|
| CN | 103151005 | A | 6/2013 |
| CN | 103745694 | A | 4/2014 |
| CN | 105629539 | A | 6/2016 |
| CN | 106875905 | A | 6/2017 |
| CN | 108172186 | A | 6/2018 |
| JP | 2010020225 | A | 1/2010 |

* cited by examiner

DISPLAY DEVICE AND CHARGING CONTROL METHOD APPLIED IN DISPLAY DEVICE

CROSS-REFERENCE TO RELATED APPLICATIONS

This is the U.S. National Stage of International Patent Application No. PCT/CN2020/091340 filed May 20, 2020, which in turn claims the benefit of Chinese Patent Application No. 202010373455.3 filed May 6, 2020.

FIELD OF INVENTION

The present disclosure relates to the field of display technology, and more particularly, to the field of charging technology for display devices, specifically involving a display device and a charging control method applied in the display device.

BACKGROUND OF INVENTION

With sizes of display devices becoming larger, resolutions are also becoming higher; for example, a charging problem of large-sized models that are ultra-high definition (UD) and have 8 k (resolution), and operates at 120 Hz has become worse. Due to a resistance-capacitance consumption and delay of metal wirings that transmit data signals inside panels, a charging rate of pixel columns near to far from a source driver gradually deteriorates, resulting in a significant difference between an upper half screen and a lower half screen when the display device displays images.

SUMMARY OF INVENTION

The present disclosure provides a display device to solve a problem that a charging rate of pixel columns near to far from a source driver gradually deteriorates, resulting in a significant difference between an upper half screen and a lower half screen when the display device displays images.

In a first aspect, the present disclosure provides a display device comprising a timing controller, a date register, a source driver, and a display panel. The timing controller is configured to receive a video signal and a data enable signal, the data enable signal is defined to comprise a vertical effective display column data and a vertical idle period of each frame of images, and the vertical effective display column data is defined to comprise a horizontal effective display pixel number data and a horizontal idle period of each pixel column. The data register is connected to an output end of the timing controller, and is configured to cache the video signal and the data enable signal. Moreover, under control of the timing controller, the data register outputs a portion of the vertical effective display column data in the vertical idle period. The source driver is connected to an output end of the data register, and is configured to output a data signal modulated corresponding to the horizontal idle period according to the video signal and the data enable signal. For the display panel, the display panel is provided with a first pixel column to an Nth pixel column that are respectively near and far from the source driver, is connected to an output end of the source driver, and is configured to receive the data signal to correspondingly control charging times from the first pixel column to the Nth pixel column. Wherein, the horizontal idle period comprises a first horizontal idle period to an Nth horizontal idle period corresponding to controlling the charging time from the first pixel column to the Nth pixel column, and an N/2th horizontal idle period to the Nth horizontal idle period are greater than the first horizontal idle period to the N/2th horizontal idle period.

Based on the first aspect, in a first embodiment of the first aspect, a sum of extension times from the N/2th horizontal idle period to the Nth horizontal idle period is not greater than a period duration in which the portion of the vertical effective display column data is output in the vertical idle period.

Based on the first embodiment of the first aspect, in a second embodiment of the first aspect, the sum of extension times from the N/2th horizontal idle period to the Nth horizontal idle period is equal to a period duration in which the portion of the vertical effective display column data is output in the vertical idle period.

Based on the first aspect, in a third embodiment of the first aspect, N is a positive integer, and when N is an odd number, N is rounded up and rounded to N/2.

Based on the first aspect, in a fourth embodiment of the first aspect, an extension time of each period from the N/2th horizontal idle period to the Nth horizontal idle period is equal.

Based on the first aspect, in a fifth embodiment of the first aspect, an extension time of each period from the N/2th horizontal idle period to the Nth horizontal idle period increases sequentially.

Based on the first aspect, when facing the display panel, the source driver is located on an upper side or a lower side of the display panel.

Based on the first aspect, in a seventh embodiment of the first aspect, the display device further comprises a gate driver, an input end of the gate driver is connected to the output end of the timing controller, and an output end of the gate driver is electrically connected to the display panel.

Based on the first aspect, in an eighth embodiment of the first aspect, when facing the display panel, the gate driver is located on a left side and/or a right side of the display panel.

In a second aspect, the present disclosure provides a charging control method applied in a display device. The display device comprises a timing controller, a data register, a source driver, and a display panel. The charging control method comprises following steps: under modulation of a pixel clock, the timing controller receives a video signal and a data enable signal, the data enable signal is defined to comprise a vertical effective display column data and a vertical idle period of each frame of images, and the vertical effective display column data is defined to comprise a horizontal effective display pixel number data and a horizontal idle period of each pixel column; under control of the timing controller, the data register outputs a portion of the vertical effective display column data in the vertical idle period; according to modulation of the video signal and the data enable signal, the source driver outputs a data signal modulated corresponding to the horizontal idle period; and display panel receives the data signal to correspondingly control charging times from a first pixel column to an Nth pixel column and located in the display panel. Wherein, the horizontal idle period comprises a first horizontal idle period to an Nth horizontal idle period corresponding to controlling the charging time from the first pixel column to the Nth pixel column, and an N/2th horizontal idle period to the Nth horizontal idle period are greater than the first horizontal idle period to the N/2th horizontal idle period.

The display device provided by the present disclosure outputs the portion of the vertical effective display column data in the vertical idle period through the data register, which can increase a sum of the charging time of the pixel column of an entire frame of images. Moreover, the increased sum of the charging time of the pixel column is distributed to each pixel column in the upper half screen by adjusting the N/2th horizontal idle period to the Nth horizontal idle period to be greater than the first horizontal idle period to the N/2th horizontal idle period, which reduces a difference between charging rates of the upper half screen and the lower half screen, and improves display uniformity of the upper half screen and the lower half screen.

DETAILED DESCRIPTION OF PREFERRED EMBODIMENTS

The In order to make a purpose, technical solutions, and effects of the present disclosure clearer, following describes the present disclosure in further detail with reference to accompanying drawings and examples. It should be understood that specific embodiments described herein are only used to explain the present disclosure, and are not used to limit the present disclosure.

Figure 1:
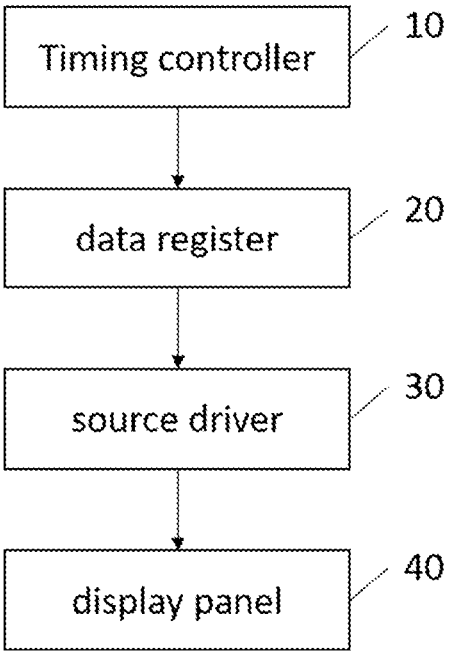
FIG. 1 is a schematic structural diagram of a display device provided by an embodiment of the present disclosure.

As shown in FIG. 1, a present embodiment provides a display device comprising a timing controller 10, a data register 20, a source driver 30, and a display panel 40, wherein the timing controller 10 is configured to receive a video signal and a data enable signal, and specifically configures parameters of the data enable signal. It should be understood that the data enable signal is defined to comprise a vertical effective display column data and a vertical idle period of each frame of images, and the vertical effective display column data is defined to comprise a horizontal effective display pixel number data and a horizontal idle period of each pixel column. An input end of the data register 20 is connected to an output end of the timing controller 10, and the data register 20 is configured to cache the video signal and the data enable signal. Moreover, under control of the timing controller 10, the data register outputs a portion of the vertical effective display column data in the vertical idle period. An input end of the source driver 30 is connected to an output end of the data register 20, and the source driver 30 receives the video signal and the data enable signal and outputs a data signal defined corresponding to the horizontal idle period according to modulation of the video signal and the data enable signal. It should be noted that the first horizontal idle period defines a row of data signals. A first row of data signals can control a write cycle of the corresponding pixel column, thereby controlling charging of the pixel column. Similarly, an Nth horizontal idle period defines the corresponding row of data signal. An input end of the display panel 40 is connected to an output end of the source driver 30 to receive the corresponding data signal, wherein the display panel 40 is provided with a first pixel column to an Nth pixel column that are respectively near and far from the source driver. It can be understood that the corresponding data signals sequentially control charging times from the first pixel column to the Nth pixel column. The first horizontal idle period to the Nth horizontal idle period one-to-one control the charging time from the first pixel column to the Nth pixel column correspondingly. An N/2th horizontal idle period to the Nth horizontal idle period are separately adjusted, so that they are greater than the first horizontal idle period to the N/2th horizontal idle period.

Wherein, a product of a sum of the vertical effective display column data and the vertical idle period of each frame of images and a sum of the horizontal effective display pixel number data and the horizontal idle period of each pixel column is relatively fixed and is related to frame rate or pixel clock frequency.

It should be noted that the display device in the present embodiment outputs the portion of the vertical effective display column data in the vertical idle period through the data register 20, which can increase a sum of the charging time of the pixel column of an entire frame of images. Moreover, the increased sum of the charging time of the pixel column is distributed to each pixel column in the upper half screen by extending a time of each period from the N/2th horizontal idle period to the Nth horizontal idle period, which reduces a difference between charging rates of the upper half screen and the lower half screen, and improves display uniformity of the upper half screen and the lower half screen.

Ultra-high definition (UD) with a frequency of 120 Hz is taken as an example, the vertical effective display column data is 2160 pixel column data. When a vertical effective display region finishes input, about 90 columns of pixel column data will be left in a cache region of the data register 20. Then, approximately 80 columns of pixel column data in the cache region are output during the vertical idle period. The charging time of an original column is 1 second/120 Hz/2250, which is 3.704 microseconds, and after the modification, the charging time of each pixel column becomes 1 second/120 Hz/2160, which is 3.86 microseconds. The charging time of each column is 0.15 microseconds longer than the original column. Hence, the increased sum of the charging time of the pixel column is a product of 0.15 microseconds and 2160, which is 324 microseconds. Then, these 324 microseconds extend the time of each horizontal idle period from the N/2th horizontal idle period to the Nth horizontal idle period, and these periods are configured to control the charging time of each pixel column in the upper half screen. Therefore, the charging time of each pixel column in the upper half screen is increased by 0.3 microseconds, and the charging rate of each pixel column in the upper half screen is improved, that is, a percentage of the charging rate of each pixel column in the upper half screen is increased by 0.3 microseconds/3.704 micrometers, which is 8.1%, so that a difference between the charging rate of each pixel column in the upper half screen and the charging rate of each pixel column in the lower half screen is reduced, thereby improving display uniformity of the upper half screen and the lower half screen.

In one of the embodiments, a sum of extension times from the N/2th horizontal idle period to the Nth horizontal idle period is not greater than a period duration in which the portion of the vertical effective display column data is output in the vertical idle period. For example, when the period duration of an output portion of the vertical effective display column number data in the vertical idle period is 324 microseconds, an extension time of any horizontal idle period from the N/2th horizontal idle period to the Nth horizontal idle period does not exceed 0.3 microseconds.

Wherein, the sum of extension times from the N/2th horizontal idle period to the Nth horizontal idle period is equal to a period duration in which the portion of the vertical effective display column data is output in the vertical idle period, which uses the increased sum of the charging time of the pixel column to maximize the charging rate of the upper half screen.

In one of the embodiments, when N is an odd number, N is rounded up and rounded to N/2. It should be noted that under normal circumstances, N is related to pixel resolution of rows, and odd numbers rarely occur. If it appears, N/2 will have a decimal point, which is not what the present disclosure wants. Therefore, when encountering this kind of situation, N/2 can be further rounded up to get an integer.

In one of the embodiments, the extension time of each period from the N/2th horizontal idle period to the Nth horizontal idle period is equal. It should be noted that the present embodiment can improve the entire charging rate of the upper half screen.

In one of the embodiments, the extension time of each period from the N/2th horizontal idle period to the Nth horizontal idle period increases sequentially. It should be noted that in the present embodiment, the charging rate of the upper half screen can be treated differently, and the charging rate is gradually strengthened to improve uniformity of the charging rate of the upper half screen for gradually deteriorating conditions.

In one of the embodiments, when facing the display panel 40, the source driver 30 is located on an upper side or a lower side of the display panel 40. It can be understood that the upper side or the lower side of the display panel 40 is provided with a bonding region, and the source driver 30 is installed in the bonding region in a form of a chip.

In one of the embodiments, the display device comprises a gate driver, an input end of the gate driver is connected to the output end of the timing controller 10, and an output end of the gate driver is electrically connected to the display panel 40.

In one of the embodiments, when facing the display panel 40, the gate driver is located on a left side and/or a right side of the display panel 40. It can be understood that the display panel 40 may be configured, but not limited to, to be provided with the gate driver on one side or the gate drivers on both sides.

In one of the embodiments, the present disclosure provides a charging control method applied in a display device, as shown in FIG. 1, the display device comprises a timing controller 10, a data register 20, a source driver 30, and a display panel 40.

Figure 2:
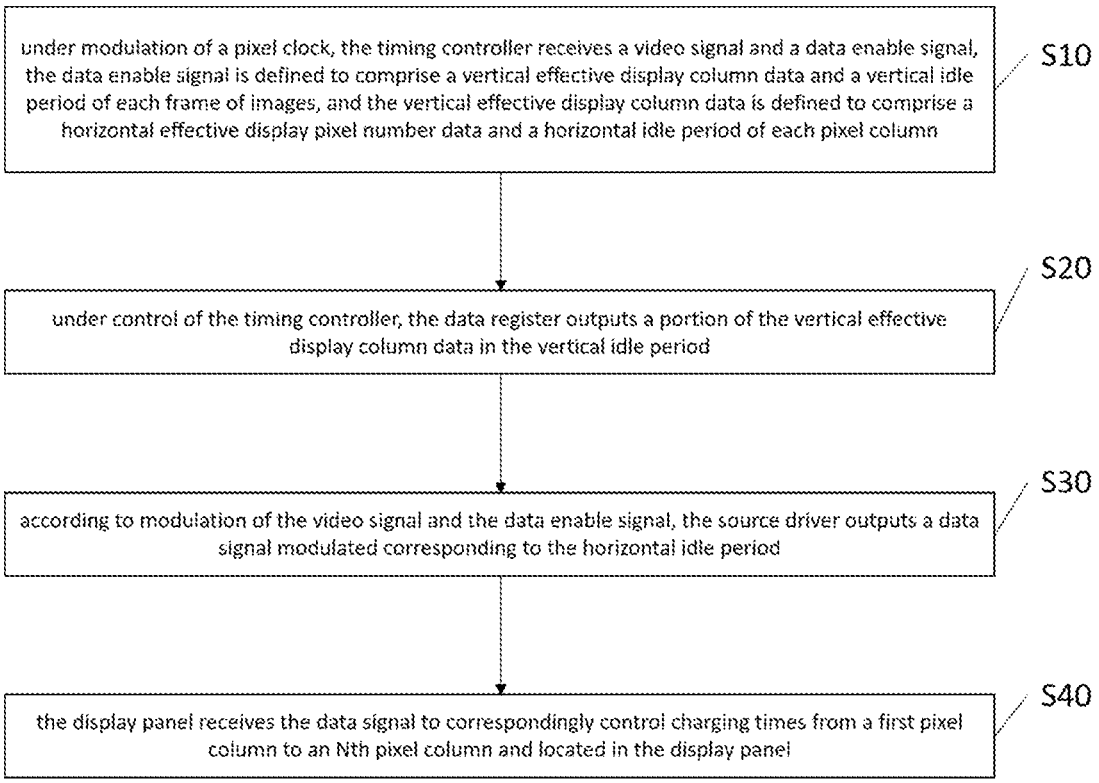
FIG. 2 is a flowchart of a charging control method applied in the display device provided by the embodiment of the present disclosure.

As shown in FIG. 2, the charging control method comprises following steps:

Step S10: under modulation of a pixel clock, the timing controller 10 receives a video signal and a data enable signal, the data enable signal is defined to comprise a vertical effective display column data and a vertical idle period of each frame of images, and the vertical effective display column data is defined to comprise a horizontal effective display pixel number data and a horizontal idle period of each pixel column.

Step S20: under control of the timing controller 10, the data register 20 outputs a portion of the vertical effective display column data in the vertical idle period.

Step S30: according to modulation of the video signal and the data enable signal, the source driver 30 outputs a data signal modulated corresponding to the horizontal idle period.

Step S40: the display panel 40 receives the data signal to correspondingly control charging times from a first pixel column to an Nth pixel column and located in the display panel.

Wherein, the horizontal idle period comprises a first horizontal idle period to an Nth horizontal idle period corresponding to controlling the charging time from the first pixel column to the Nth pixel column. An N/2th horizontal idle period to the Nth horizontal idle period are greater than the first horizontal idle period to the N/2th horizontal idle period.

It can be understood that the charging control method applied in the display device provided in the present embodiment may be, but not limited to, the sequence of the above steps, or may be executed in other sequences, and the charging control method may be implemented.

It can be understood that, for those of ordinary skill in the art, equivalent replacements or changes can be made according to technical solutions and inventive concepts of the present disclosure, and all such changes or replacements should fall within a protection scope of claims appended to the present disclosure.

What is claimed is:

1. A display device, comprising:

a timing controller configured to receive a video signal and a data enable signal, wherein the data enable signal is defined to comprise a vertical effective display column data and a vertical idle period of each frame of images, and the vertical effective display column data is defined to comprise a horizontal effective display pixel number data and a horizontal idle period of each pixel column;

a data register connected to an output end of the timing controller, and configured to cache the video signal and the data enable signal, wherein under control of the timing controller, the data register outputs a portion of the vertical effective display column data in the vertical idle period;

a source driver connected to an output end of the data register, and configured to output a data signal modulated corresponding to the horizontal idle period according to the video signal and the data enable signal; and a display panel, wherein the display panel is provided with a first pixel column to an Nth pixel column that are respectively near and far from the source driver, connected to an output end of the source driver, and configured to receive the data signal to correspondingly control charging times from the first pixel column to the Nth pixel column;

wherein the source driver is located on an upper side or a lower side of the display panel;

the horizontal idle period comprises a first horizontal idle period to an Nth horizontal idle period corresponding to controlling the charging time from the first pixel column to the Nth pixel column; and an N/2th horizontal idle period to the Nth horizontal idle period are greater than the first horizontal idle period to the N/2th horizontal idle period.

2. The display device as claimed in claim 1, wherein a sum of extension times from the N/2th horizontal idle period to the Nth horizontal idle period is not greater than a period duration in which the portion of the vertical effective display column data is output in the vertical idle period.

3. The display device as claimed in claim 2, wherein the sum of extension times from the N/2th horizontal idle period to the Nth horizontal idle period is equal to a period duration in which the portion of the vertical effective display column data is output in the vertical idle period.

4. The display device as claimed in claim 1, wherein N is a positive integer; and when N is an odd number, N is rounded up and rounded to N/2.

5. The display device as claimed in claim 1, wherein an extension time of each period from the N/2th horizontal idle period to the Nth horizontal idle period is equal.

6. The display device as claimed in claim 1, wherein an extension time of each period from the N/2th horizontal idle period to the Nth horizontal idle period increases sequentially.

7. The display device as claimed in claim 1, wherein the display device comprises a gate driver, an input end of the gate driver is connected to the output end of the timing controller, and an output end of the gate driver is electrically connected to the display panel.

8. The display device as claimed in claim 7, wherein the gate driver is located on a left side and/or a right side of the display panel.

9. A display device, comprising:

a timing controller configured to receive a video signal and a data enable signal, wherein the data enable signal is defined to comprise a vertical effective display column data and a vertical idle period of each frame of images, and the vertical effective display column data is defined to comprise a horizontal effective display pixel number data and a horizontal idle period of each pixel column;

a data register connected to an output end of the timing controller, and configured to cache the video signal and the data enable signal, wherein under control of the timing controller, the data register outputs a portion of the vertical effective display column data in the vertical idle period;

a source driver connected to an output end of the data register, and configured to output a data signal modulated corresponding to the horizontal idle period according to the video signal and the data enable signal; and a display panel, wherein the display panel is provided with a first pixel column to an Nth pixel column that are respectively near and far from the source driver, connected to an output end of the source driver, and configured to receive the data signal to correspondingly control charging times from the first pixel column to the Nth pixel column;

wherein the horizontal idle period comprises a first horizontal idle period to an Nth horizontal idle period corresponding to controlling the charging time from the first pixel column to the Nth pixel column; and an N/2th horizontal idle period to the Nth horizontal idle period are greater than the first horizontal idle period to the N/2th horizontal idle period.

10. The display device as claimed in claim 9, wherein a sum of extension times from the N/2th horizontal idle period to the Nth horizontal idle period is not greater than a period duration in which the portion of the vertical effective display column data is output in the vertical idle period.

11. The display device as claimed in claim 10, wherein the sum of extension times from the N/2th horizontal idle period to the Nth horizontal idle period is equal to a period duration in which the portion of the vertical effective display column data is output in the vertical idle period.

12. The display device as claimed in claim 9, wherein N is a positive integer; and when N is an odd number, N is rounded up and rounded to N/2.

13. The display device as claimed in claim 9, wherein an extension time of each period from the N/2th horizontal idle period to the Nth horizontal idle period is equal.

14. The display device as claimed in claim 9, wherein an extension time of each period from the N/2th horizontal idle period to the Nth horizontal idle period increases sequentially.

15. The display device as claimed in claim 9, wherein the display device comprises a gate driver, an input end of the gate driver is connected to the output end of the timing controller, and an output end of the gate driver is electrically connected to the display panel.

16. The display device as claimed in claim 15, wherein the gate driver is located on a left side and/or a right side of the display panel.

17. A charging control method applied in a display device, wherein the display device comprises a timing controller, a data register, a source driver, and a display panel; and the charging control method comprises following steps:

under modulation of a pixel clock, the timing controller receives a video signal and a data enable signal, the data enable signal is defined to comprise a vertical effective display column data and a vertical idle period of each frame of images, and the vertical effective display column data is defined to comprise a horizontal effective display pixel number data and a horizontal idle period of each pixel column;

under control of the timing controller, the data register outputs a portion of the vertical effective display column data in the vertical idle period;

according to modulation of the video signal and the data enable signal, the source driver outputs a data signal modulated corresponding to the horizontal idle period; and the display panel receives the data signal to correspondingly control charging times from a first pixel column to an Nth pixel column and located in the display panel;

wherein the horizontal idle period comprises a first horizontal idle period to an Nth horizontal idle period corresponding to controlling the charging time from the first pixel column to the Nth pixel column; and an N/2th horizontal idle period to the Nth horizontal idle period are greater than the first horizontal idle period to the N/2th horizontal idle period.

* * * * *